US007686557B2

(12) United States Patent
Albrecht et al.

(10) Patent No.: US 7,686,557 B2
(45) Date of Patent: Mar. 30, 2010

(54) DEVICE FOR BACKING BOOK BLOCKS

(75) Inventors: Manfred Albrecht, Luebbecke (DE); Torsten Meineke, Bassum (DE)

(73) Assignee: Kolbus GmbH & Co. KG, Rahden (DE)

( * ) Notice: Subject to any disclaimer, the term of this patent is extended or adjusted under 35 U.S.C. 154(b) by 485 days.

(21) Appl. No.: 11/788,933

(22) Filed: Apr. 23, 2007

(65) Prior Publication Data

US 2008/0019801 A1 Jan. 24, 2008

(30) Foreign Application Priority Data

May 18, 2006 (DE) ..... 10 2006 023 285

(51) Int. Cl.
*B42C 5/02* (2006.01)
*B42C 5/00* (2006.01)

(52) U.S. Cl. ..... 412/30; 412/22; 412/25

(58) Field of Classification Search ..... 412/22, 412/25, 29, 30, 1, 9, 18, 19
See application file for complete search history.

(56) References Cited

U.S. PATENT DOCUMENTS 2,455,971 A * 12/1948 Bosch ..... 412/37
3,413,669 A * 12/1968 Thorp ..... 412/13
4,750,852 A * 6/1988 Wagner ..... 412/1
5,104,275 A * 4/1992 Rathert ..... 412/1
5,556,244 A 9/1996 Begemann et al.
6,158,940 A * 12/2000 Nehring ..... 412/9
6,171,045 B1 * 1/2001 Nehring et al. ..... 412/30
6,497,544 B1 * 12/2002 Schmucker et al. ..... 412/17
7,134,823 B2 * 11/2006 Albrecht et al. ..... 412/22

FOREIGN PATENT DOCUMENTS

EP 0 676 303 A1 10/1995

* cited by examiner

*Primary Examiner*—Dana Ross
*Assistant Examiner*—Pradeep C Battula
(74) *Attorney, Agent, or Firm*—Alix, Yale & Ristas, LLP

(57) ABSTRACT

A device for backing rounded book blocks (2) clamped near the spine, by a pressing beam (9) and a slide (7) that accommodates the pressing beam (9) and can be alternately displaced along arc-shaped races (6) in a swinging fashion by driving means (17) in a height-adjustable supporting bearing (5) that is laterally supported against the effect of a spring element (29). Members are provided for controlling (21, 22, 32, 33) the lateral position of the supporting bearing (5) and for lowering and raising (10, 11, 12) the pressing beam into the starting position for its return stroke. An eccentric starting position is realized during the lowering of the pressing beam (9) on the spine (2*a*), in the form of a swinging position of the slide (7) that is offset toward the opposite side of the spine center (2*b*) referred to the respective side to be backed thereafter.

9 Claims, 4 Drawing Sheets

15
1
14
13
11
10
12
16
5
7
7a
17
v=0
8
6
21
9
2b
32a
2a
F
F
22
32
32d
2c
33
4
2
3
2b
v=0

DEVICE FOR BACKING BOOK BLOCKS

BACKGROUND

The present invention pertains to a device for backing book blocks.

EP 0 676 303 B1 shows a device for backing book blocks (FIGS. 11 and 12), in which the supporting bearing is laterally supported against the effect of disc spring assemblies in the form of a spring element such that a pressing force for turning over the sheets of the book block is applied in the lateral regions of the spine. During the return stroke of the pressing beam toward the center of the block spine, the effect of the disc spring assembly is neutralized in order to prevent the outer sheets that are laterally turned over from being carried along. In this case, the motion of the pressing beam may be additionally controlled such that it clears the block spine during its return stroke due to an upward motion and is subsequently placed back on the spine in the block center in order to back the opposite side of the block spine.

The control of the disc spring assemblies and therefore the lateral position of the supporting bearing is realized with rams that are arranged laterally of the supporting bearing and controlled by cam wheels, wherein these rams act upon the supporting bearing in alternating directions and transfer the disc spring assemblies from a supporting position for applying a pressing force into a relieving position.

The above-described position control, in which the spring force is relieved, makes it possible to back sheets with high as well as low rigidity without causing the sheets to buckle or to be pushed back again. In this case, it suffices to back each side of the block spine once in order to achieve the desired mushroom-like spine shape.

When the pressing beam is centrally placed on the block spine, it may occur, however, that the pressing beam causes the central sheets to buckle such that creases are formed. A loose contact between the pressing beam and the center of the block spine, in contrast, reduces the smoothing of the elongations in the glue film caused by the rounding, whereby the previously created rounding in the center of the block spine is stabilized.

SUMMARY

The present invention is based on the objective of developing a device for backing book blocks of the general kind described above, that makes it possible to improve the quality of the book blocks.

According to the present disclosure, this objective is attained in that the pressing beam is arranged in an eccentric starting position when the pressing beam is lowered on the book block. The slide accommodating the pressing beam is displaced away from the spine center into a swinging position that lies on the opposite side referred to the respective side to be backed thereafter. Consequently, the block spine center is also swept with each backing of one side without causing the pressing beam to act upon the outer trailing sheets of the book block referred to the pressing motion which were backed during the opposite motion of the pressing beam or are yet to be backed. An exact height adjustment is not required because the block spine center is swept during two oppositely directed rolling/drawing motions without buckling the sheets in the block center by a pressing beam that is moved toward the block center from above.

According to an additional development, the supporting bearing is laterally displaced away from the block center toward the same side in the eccentric starting position such that the pressing beam is initially placed on the block spine with its center of swinging motion that approximately lies in the effective area and the ensuing rolling/drawing motion of the pressing beam takes place while it is in constant contact with the block spine, namely without causing undesirable shifting of the sheets.

Advantageous additional developments will become evident from the detailed description below.

BRIEF DESCRIPTION OF THE DRAWING

Characteristics of the invention are described in greater detail below with reference to one preferred embodiment that is illustrated in the accompanying drawing. In these drawings.

DETAILED DESCRIPTION

Figure 1:
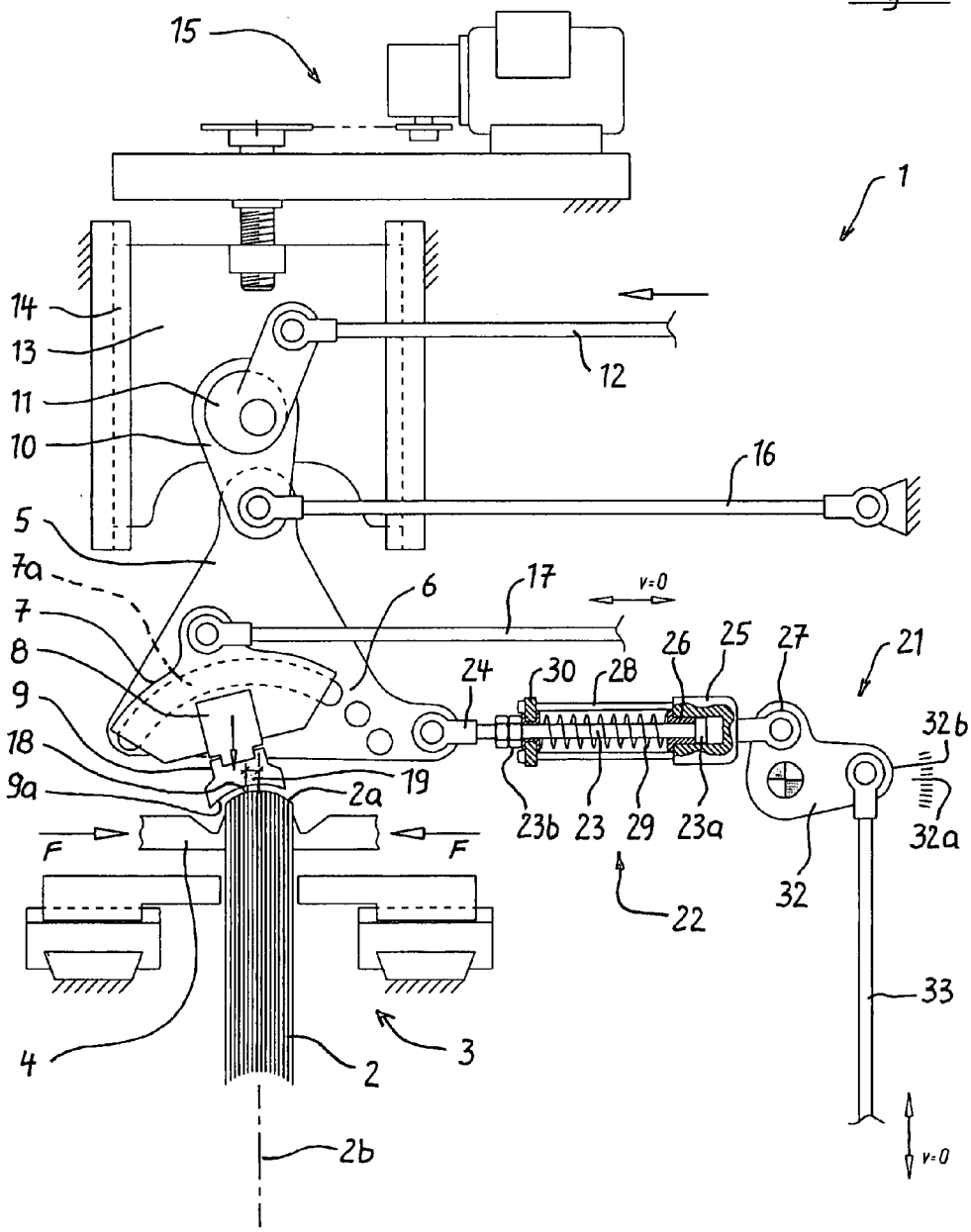
FIG. 1 shows a partially schematic representation of a backing station with the pressing beam positioned in the starting position for its lowering motion.

With reference to the backing station as shown in the Figures, it should be understood that after a spine rounding process, the book blocks 2 are transported into a backing station 1 by means of a reciprocating transport clamp carriage 3, wherein the book blocks 2 with their rounded spines 2*a* are provided with a mushroom-like spine shape that is defined by a deep or flat joint 2*c*.

The backing process is carried out with a forming tool realized in the form of a pressing beam 9 that moves back and forward over the entire spine width of the book blocks 2 and has a concave effective area 9*a*, whereby the sheets of the book block 2 are turned over toward both sides from the center 2*b* of the block spine 2 under the influence of pressure and friction, namely at an angle that increases outward. In order to carry out the backing process, the book block 2 is clamped between backing jaws 4 with a defined projection from the end of the rounding.

The pressing beam 9 is exchangeably fixed on a receptacle 8 that is situated in a bridge-like slide 7 provided with arc-shaped grooves 7*a* on both sides. The grooves guide the slide 7 in a swinging fashion in assigned roller races 6 of a supporting bearing 5 such that the center of swinging motion 18 approximately lies in the effective area 9*a*. The pressing beam 9 is conventionally moved back and forward by the main drive with the aid of a driving rod 17 that engages on the slide 7 in an articulated fashion.

The aforementioned supporting bearing 5 is suspended in a swinging fashion on a height-adjustable connecting rod 10, wherein the common center of motion is centrally guided over the block spine 2 a by a coupling rod 16 that is rigidly connected to the machine frame while the supporting bearing 5 is supported with respect to a swinging motion about the aforementioned center of motion by a laterally connected cushioning coupling rod 22.

In order to realize the cyclic lowering and raising of the pressing beam 9 on and from the block spine 2*a*, the connecting rod 10 is vertically displaced by a camshaft 11 that is controlled by a driving rod 12. The height adjustment of the pressing beam 9 to the respective book block height is achieved by supporting the camshaft 11 in lateral plates 13 that can be vertically fixed by an adjusting device 15 while being guided in guides 14 of the machine frame.

The pressing beam 9 is eccentrically lowered on the block spine 2*a* from above in a swinging position that is offset relative to the block center 2*b*. The slide 7 with the pressing beam 9 accommodated therein is subjected to a lateral swinging motion of defined angle, for example, 15°. Its center of swinging motion 18 is additionally displaced away from the block center 2*b* by the offset 19 between the center lines due to the lateral displacement of the supporting bearing 5, such that the displaced pressing beam 9 is initially placed on the block spine 2*a* with the center of swinging motion 18. No undesirable shifting of the sheets occurs during this process and the pressing beam 9 does not act in the lateral area of this block spine side.

A positioning control 21 is provided for laterally displacing the supporting bearing 5. The positioning control varies the coupling point of the cushioning coupling rod 22. The coupling point is arranged on a lever 32 that is supported in the frame in a pivoted fashion by a driving rod 33 of conventional driving means that are not illustrated in greater detail. In FIGS. 1 to 4, the respective position is displayed on a scale by means of a dial arranged on the lever 32. Starting from a center position 32*a*, first and second offset positions 32*b*, 32*c* are assumed depending on the side of the block spine 2*a*, on which the pressing beam 9 is placed.

After the pressing beam 9 is placed on the block spine, its swinging motion for backing the opposite side of the block spine 2*a* is initiated by the driving rod 17, wherein the supporting bearing 5 is returned into the cushioned center position 32*a* during the swinging motion up to the block center 2*b*. During the continued swinging motion of the pressing beam 9, the supporting bearing 5 laterally yields to the cushioning coupling rod 22 against the spring force such that the pressing beam 9 carries out a rolling/drawing motion and a pressing force is applied to the lateral regions of the block spine 2*a* in order to turn over the sheets of the book block 2.

The cushioning coupling rod 22 is realized in the form of a rod 23 that is displaceably guided in bushings 26, 30*a* and *b* of a receptacle 25. An articulated end 24 of the rod 23 serves for connecting the coupling rod 22 to the supporting bearing 5, wherein a second articulated end 27 is situated in the receptacle 25 in order to connect the coupling rod 22 to the lever 32.

The bushing 26 of the aforementioned bushings 26, 30*a* and *b* is displaceably accommodated in the receptacle 25 while the bushings 30*a* and *b* are arranged in a holder 30 that is displaceably guided on tie rods 28 extending away from the receptacle 25. A pressure spring 29 is situated between the bushings 26 and 30*b* that are respectively provided with a stop, wherein the pressure spring presses apart the aforementioned arrangement against a shoulder 23*a* and nuts 23*b* arranged on the rod 23 in order to realize a defined length of the coupling rod 22 in the unstressed state.

Figure 2:
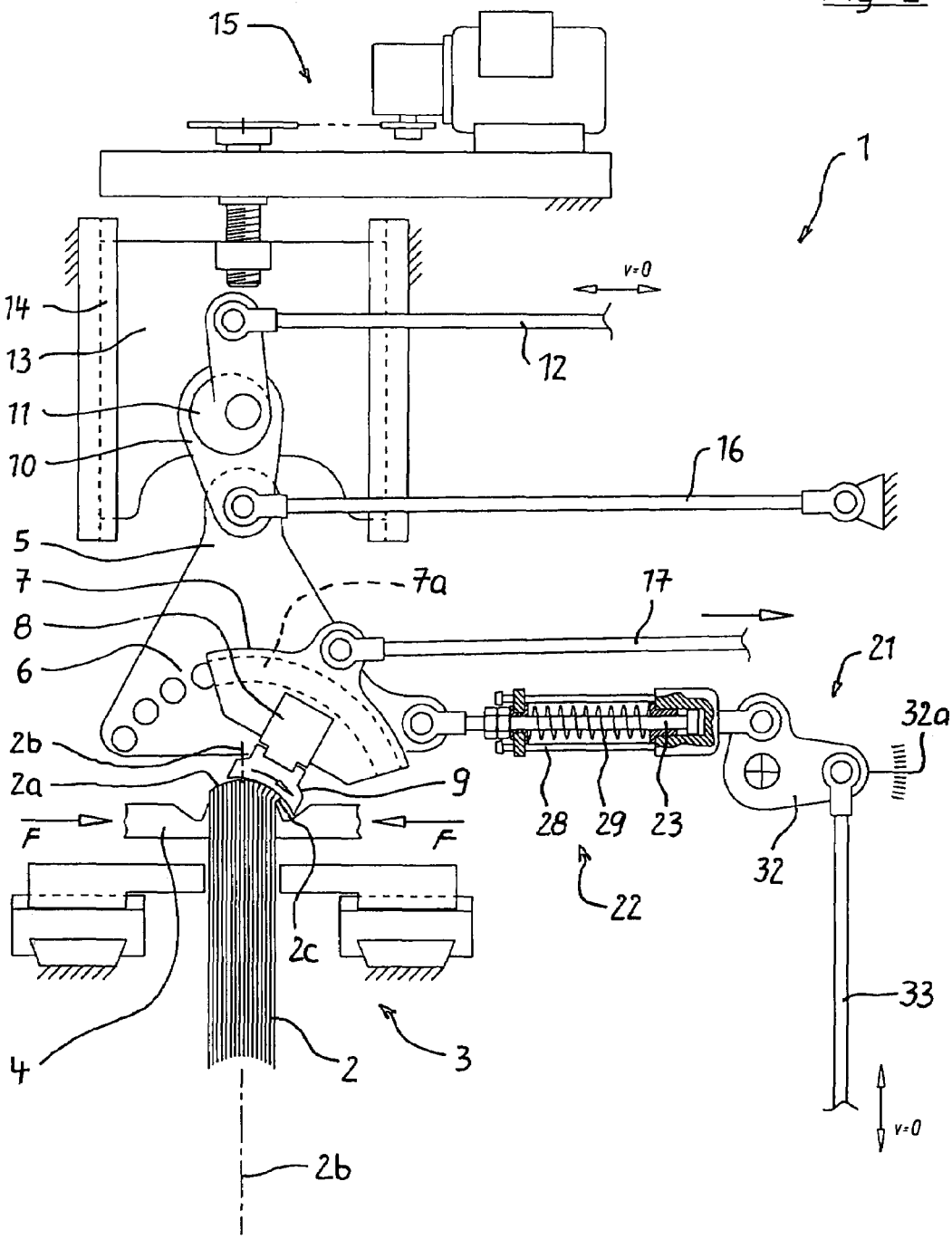
FIG. 2 shows an identical representation of the backing station with the lowered pressing beam carrying out the backing motion.
Figure 3:
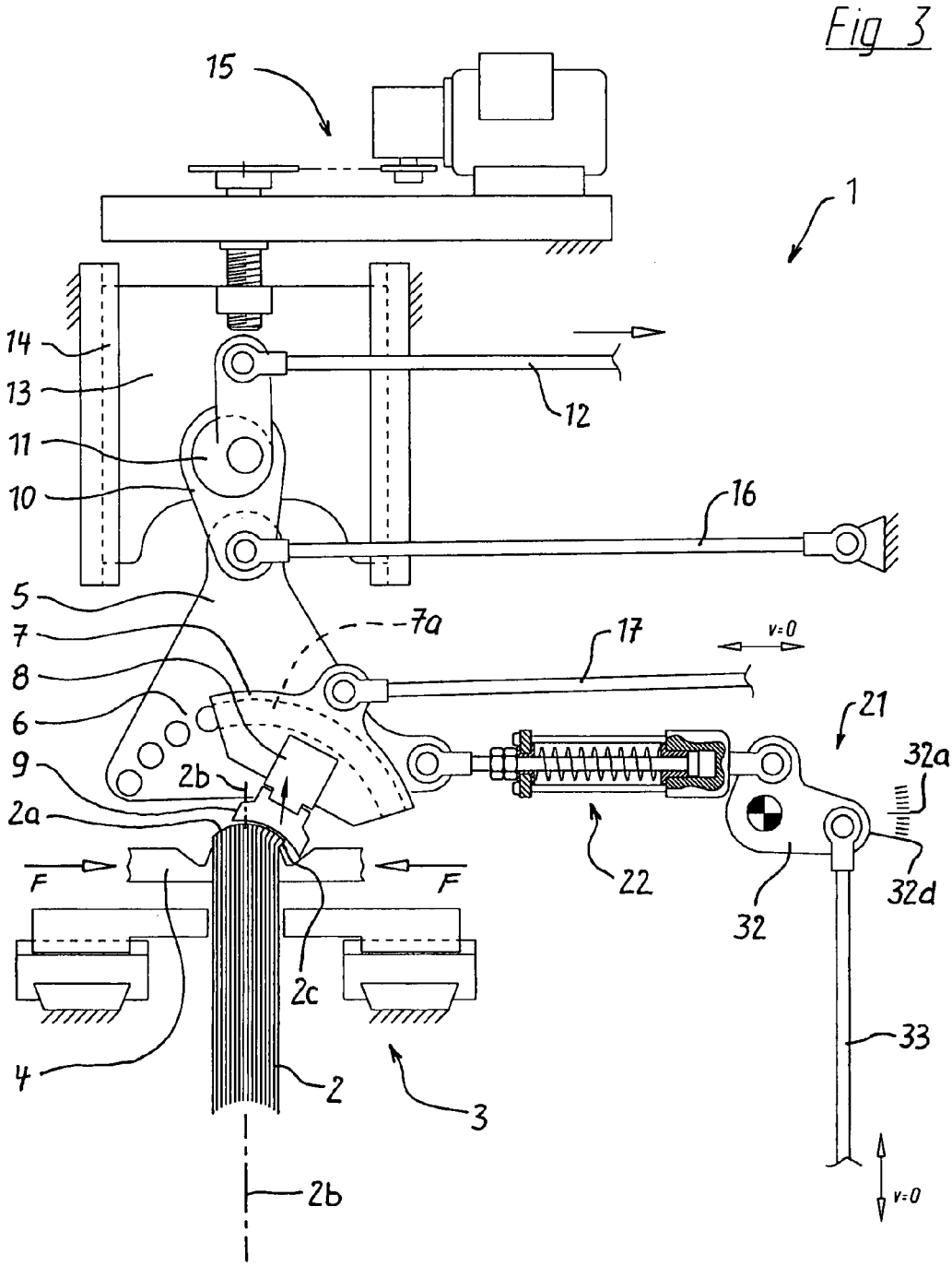
FIG. 3 shows the backing station while the pressing beam is raised at the end of a backing motion.

When a compressive force acts upon the coupling rod 22 from outside in accordance with the backing process shown in FIG. 2, the rod 23 presses against the compression spring 29 via the nut 23*b*, the holder 30 and the bushings 30*a* and *b* such that the coupling rod 22 is shortened due to the displacement of the holder 30 on the tie rods 28 and exerts a force of reaction in the form of a compressive force upon the supporting bearing 5.

At the end of the first backing process, the lever 32 is displaced into a relieving position 32*d* such that the pressure spring 29 is relieved. According to FIG. 3, the relieving stroke is so long that the coupling rod 22 reassumes its unstressed length and the pressing beam 9 is quasi drawn away from the block spine 2*a*.

Figure 4:
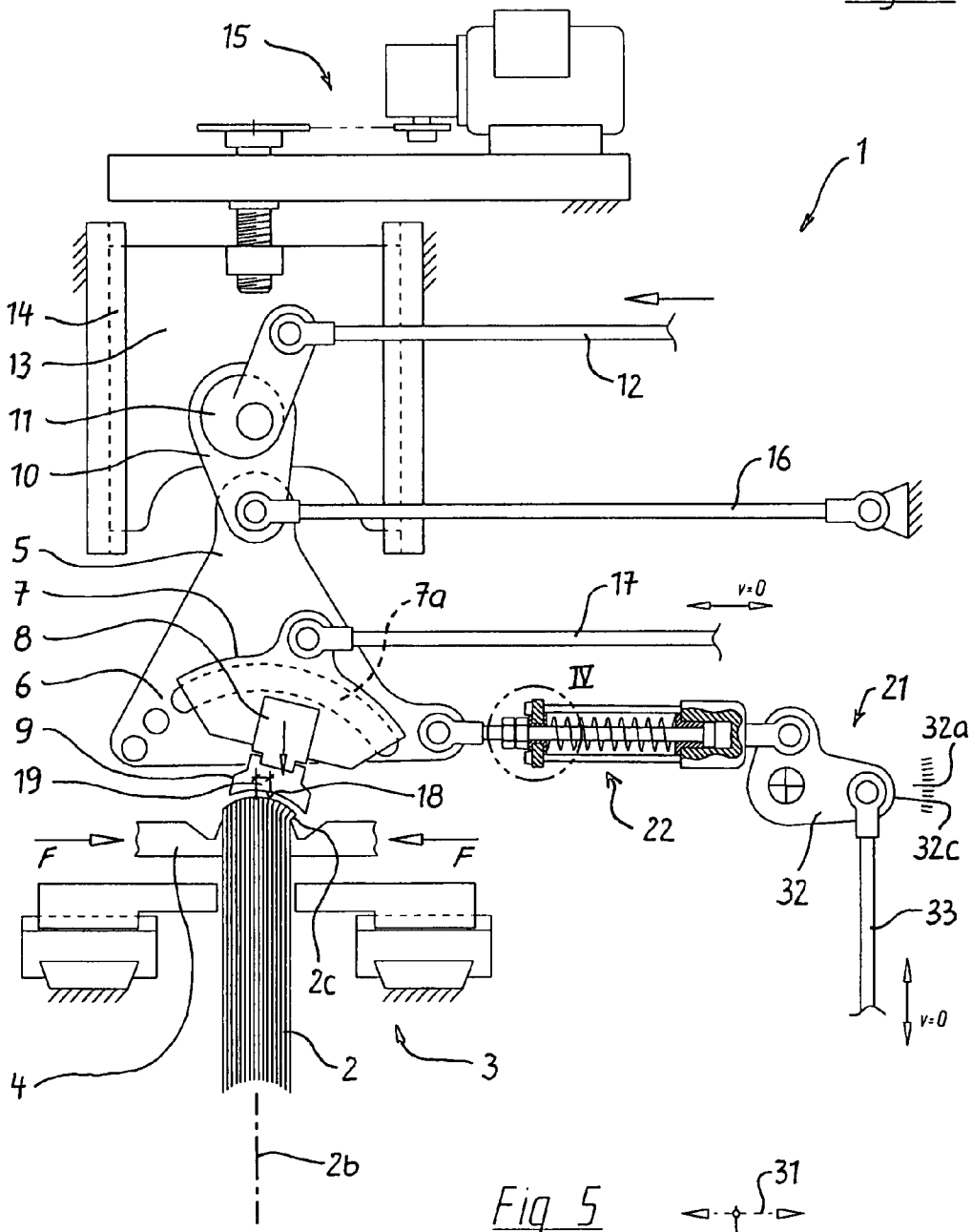
FIG. 4 shows the backing station with the pressing beam positioned in a second starting position.

The pressing beam 9 is raised by means of the driving rod 12, the camshaft 11, the connecting rod 10 and the supporting bearing 5 and caused to swing back into a second starting position for backing the opposite side of the block spine 2*a* by the driving rod 17 and the slide 7*a* as shown in FIG. 4. During this process, the position control 21 displaces the supporting bearing 5 into a correspondingly offset position that is defined by the displacement 32*c* of the lever 32.

During the backing of the second side of the block spine 2*a*, a tractive force becomes effective on the coupling rod 22 after the coupling rod 22 is returned into its center position 32*a*. This tractive force causes the bushing 26 to be displaced in the receptacle 25 against the spring force of the compression spring 29. The supporting bearing 5 yields toward the respective backing side with a controlled force due to the elongation of the coupling rod 22 such that the desired rolling/drawing motion takes place again and a pressing force acts upon the block spine 2*a*.

At the end of the second backing process, the lever 32 is displaced into a relieving position for relieving the compression spring 29. The pressing beam 9 is raised and moved back into its first starting position. During this process, the completely backed book block 2 is transported to an additional processing device by the transport clamp carriage 3 while a new rounded book block 2 is simultaneously supplied.

Figure 5:
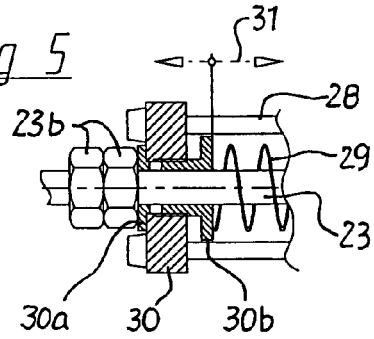
FIG. 5 shows a detailed illustration of the spring force adjustment.

A spring force adjustment 31 is provided in order to adapt the backing force to the respective composition of the sheets. According to FIG. 5, this is achieved by varying the distance between the two supporting points for the pressure spring 29 by means of the bushing 30*b* screwed into the holder 30.

The invention claimed is:

1. A device for the mechanized backing of rounded book blocks (2) that are clamped adjacent the book block spine, comprising:

a pressing beam (9) having an effective area (9*a*) that acts upon the block spine (2*a*) with a pressing force;

a slide (7) that accommodates the pressing beam (9) and can be alternately displaced along arc-shaped races (6) in a swinging fashion by driving means (17), toward one side and the other side of the block spine (2*a*) relative to a spine center (2*b*), in a height-adjustable supporting bearing (5) that is laterally supported against the effect of a spring element (29);

means (21, 22, 32, 33) for controlling the lateral position of the supporting bearing (5);

means (10, 11, 12) for lowering the pressing beam (9) onto the block spine (2*a*) in a pressing stroke and for raising the pressing beam to a starting position for a return stroke;

wherein said lowering produces an eccentric starting position of the pressing beam (9) on the block spine (2*a*) in the form of a swinging position of the slide (7) that is offset toward the opposite side of the block spine center (2*b*) relative to the respective side to be backed thereafter.

2. The device according to claim 1, wherein the supporting bearing (5) is laterally offset relative to the block spine center (2*b*) toward the same side in the eccentric starting position such that the pressing beam (9) is placed on the block spine with its center of swinging motion (18) that approximately lies in the effective area (9*a*).

3. The device according to claim 2, wherein the supporting bearing (5) is returned into the cushioned center position (32*a*) while the pressing beam (9) swings up to the block spine center (2*b*) in order to back and turn over the sheets on the actual block spine side during the continued swinging motion of the pressing beam (9).

4. The device according to claim 3, wherein the position control for the supporting bearing (9) is realized by displacing the position of the supporting point for the spring element (22, 29) that supports the supporting bearing (5).

5. The device according to claim 3, including an adjustable spring force (31) of the spring element (22, 29) that supports the supporting bearing (5).

6. The device according to claim 2, wherein the position control for the supporting bearing (9) is realized by displacing the position of the supporting point for the spring element (22, 29) that supports the supporting bearing (5).

7. The device according to claim 6, including an adjustable spring force (31) of the spring element (22, 29) that supports the supporting bearing (5).

8. The device according to claim 2 including an adjustable spring force (31) of the spring element (22, 29) that supports the supporting bearing (5).

9. The device according to claim 1, including an adjustable spring force (31) of the spring element (22, 29) that supports the supporting bearing (5).

* * * * *